US005664842A

United States Patent [19]

Tseng

[11] Patent Number: 5,664,842

[45] Date of Patent: Sep. 9, 1997

[54] HEIGHT-ADJUSTABLE ARMREST UNIT FOR A CHAIR

[75] Inventor: Chuen-Jong Tseng, Chiayi Hsien, Taiwan

[73] Assignee: Shin Yeh Enterprise Co., Ltd., Taiwan

[21] Appl. No.: 653,150

[22] Filed: May 24, 1996

[51] Int. Cl.[6] ..... A47C 7/54

[52] U.S. Cl. ..... 297/411.36; 297/353

[58] Field of Search ..... 297/353, 411.36

[56] References Cited

U.S. PATENT DOCUMENTS

| | | | |
|---|---|---|---|
| 5,037,158 | 8/1991 | Crawford | 297/353 |
| 5,265,938 | 11/1993 | Melhuish et al. | 297/411.36 |
| 5,318,347 | 6/1994 | Tseng | 297/411.36 |
| 5,324,096 | 6/1994 | Schultz | 297/353 X |
| 5,368,365 | 11/1994 | Feldberg | 297/411.36 |
| 5,382,079 | 1/1995 | Wilson et al. | 297/411.36 |
| 5,393,125 | 2/1995 | Watson et al. | 297/411.36 |
| 5,536,070 | 7/1996 | Lemmen | 297/411.36 X |

*Primary Examiner*—Peter M. Cuomo
*Assistant Examiner*—Stephen Vu
*Attorney, Agent, or Firm*—Ladas & Parry

[57] ABSTRACT

A height-adjustable armrest unit for a chair includes a support, a generally upright sleeve, a leverage body, and a biasing member. The support is fixed on a seat of the chair and includes an upright plate portion which has an upright guiding slot formed therethrough and a column of engaging notches communicated with the slot. The sleeve is mounted on the upright plate portion of the support. The leverage body has an intermediate portion mounted pivotally on a first inner wall of the upright sleeve, an actuated upper end portion, and a lower end portion with a lock pin axially projecting therefrom and extending slidably into the guiding slot in the plate portion. The biasing member biases the upright sleeve to push the lock pin to engage a selected one of the notches. The upper end portion of the leverage body can be actuated against biasing action of the biasing member to disengage the lock pin from the selected one of the notches so as to retract into the guiding slot in the plate portion. The leverage body and the upright sleeve are movable relative to the support by shifting the lock pin along the guiding slot so as to enable engagement of the lock pin with another one of the notches.

4 Claims, 5 Drawing Sheets

HEIGHT-ADJUSTABLE ARMREST UNIT FOR A CHAIR

BACKGROUND OF THE INVENTION

1. Field of the Invention

This invention relates to an armrest unit for a chair, more particularly to a height-adjustable armrest unit for a chair.

2. Description of the Related Art

U.S. Pat. No. 5,318,347 discloses a height-adjustable armrest unit for a chair. The armrest unit includes a support, a vertical sleeve, and a leverage body. The support is adapted to be mounted securely on a seat of the chair and includes a vertical plate portion with a column of positioning holes formed therethrough. The sleeve is disposed on the vertical plate portion of the support and has a pair of pivot holes respectively formed in inner surfaces of two opposite walls thereof. The leverage body includes an actuated upper portion, an engaging tongue projecting from a lower end portion of the leverage body to engage selectively one of the positioning holes in the support, and a pair of pivot pins respectively secured to an intermediate portion of the leverage body between the actuated upper end portion and the engaging tongue so as to engage the pivot holes in the vertical sleeve respectively. Accordingly, when the actuated end portion of the leverage body is actuated to disengage the engaging tongue of the leverage body from one of the positioning holes in the support, the assembly of the leverage body and the vertical sleeve can be moved relative to the support so as to engage the engaging tongue of the leverage body within another one of the positioning holes in the support, thereby adjusting the height of the sleeve.

A drawback of the above-mentioned adjustable armrest unit resides in that during the height adjustment operation, the assembly of the vertical sleeve and the leverage body may occasionally and accidentally disengage from the plate portion of the support, thereby inconveniencing the user of the chair.

SUMMARY OF THE INVENTION

The object of this invention is to provide a height-adjustable armrest unit for a chair, which armrest unit permits ease of adjustment of the height thereof without resulting in its disengagement from the seat of the chair.

Accordingly, the height-adjustable armrest unit of this invention includes a support adapted to be mounted on a seat of a chair, a generally upright sleeve, a leverage body, and a biasing member. The support includes an upright plate portion which has an upright guiding slot formed therethrough and a column of engaging notches communicated with the slot. The sleeve is mounted on the upright plate portion of the support. The leverage body includes an intermediate portion mounted pivotally on a first inner wall of the upright sleeve, an actuated upper end portion, and a lower end portion which includes a lock pin axially projecting therefrom and extending slidably into the guiding slot in the plate portion. The biasing means biases the upright sleeve to push the lock pin to engage a selected one of the notches. The upper end portion of the leverage body can be actuated against the biasing action of the biasing means to disengage the lock pin from the selected one of the notches so as to retract into the guiding slot in the plate portion. The leverage body and the upright sleeve are movable relative to the support by shifting the lock pin along the guiding slot so as to enable engagement of the lock pin with another one of the notches.

BRIEF DESCRIPTION OF THE DRAWINGS

Other features and advantages of this invention will become more apparent in the following detailed description of the preferred embodiment with reference to the accompanying drawings, in which.

DETAILED DESCRIPTION OF THE PREFERRED EMBODIMENT

Figure 1:
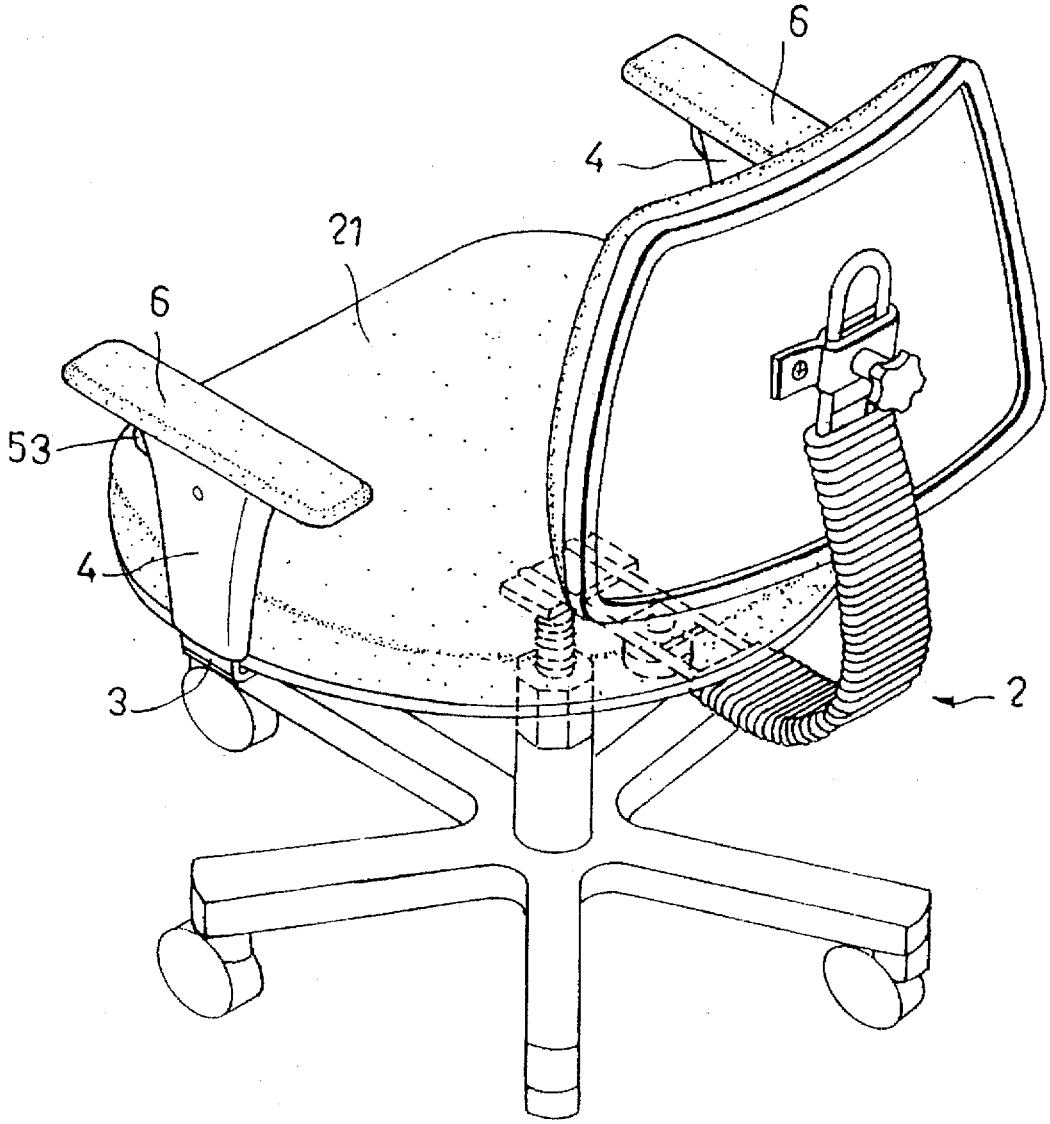
FIG. 1 illustrates a chair provided with two height-adjustable armrest units of this invention.
Figure 2:
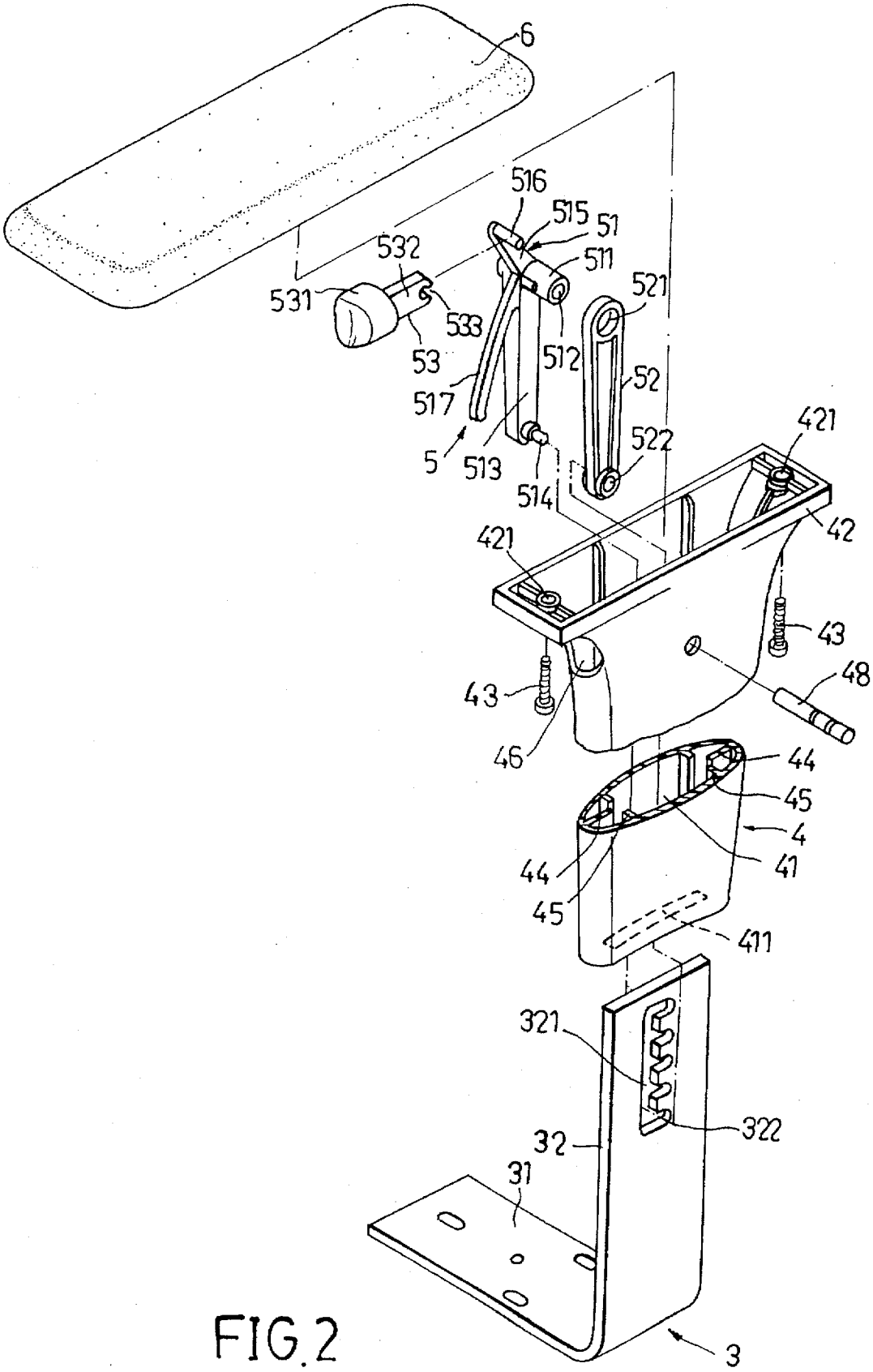
FIG. 2 is an exploded view of an armrest unit of this invention.
Figure 3:
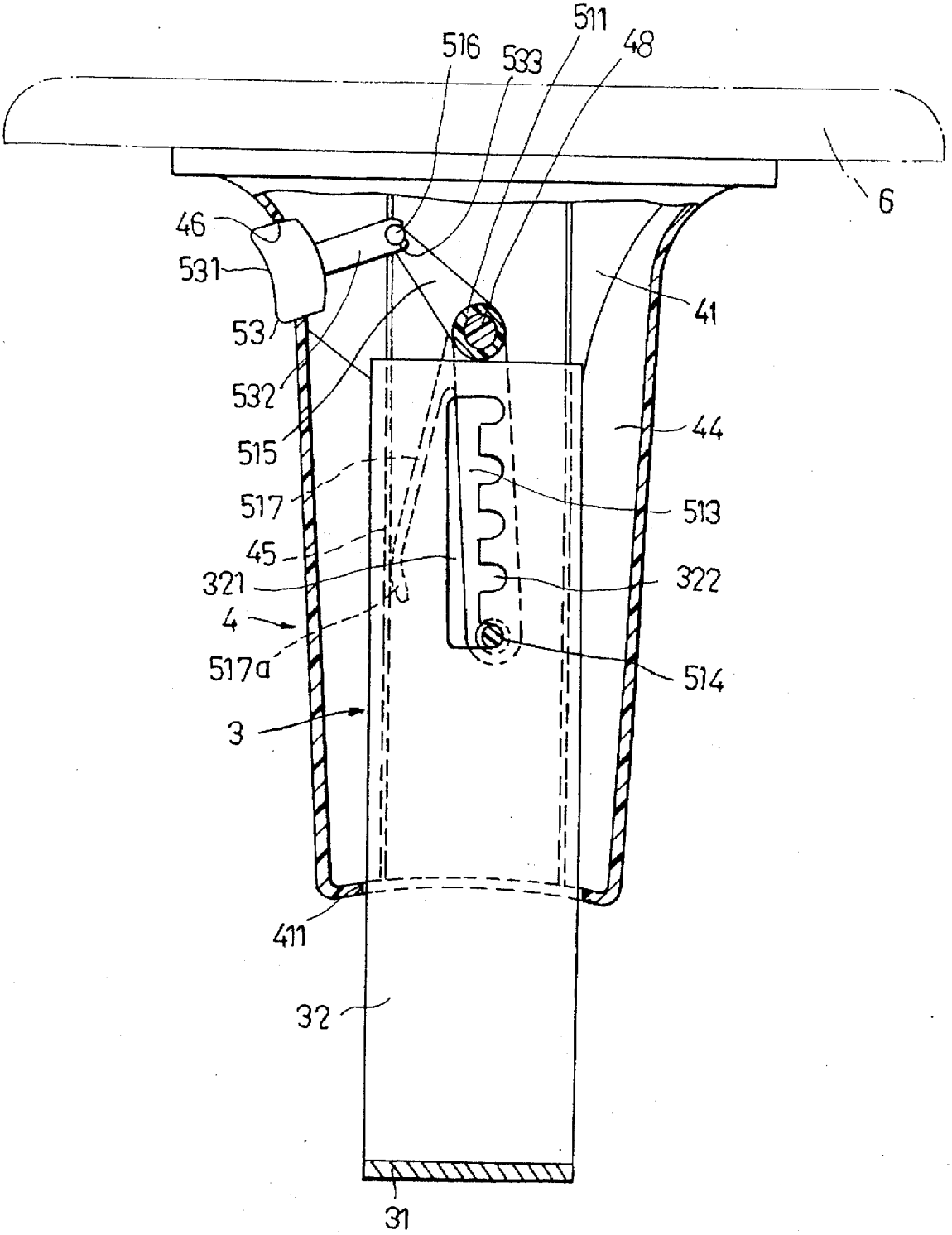
FIG. 3 is a partly sectional schematic view illustrating the interior of the armrest unit of this invention.

Referring to FIGS. 1, 2 and 3, the preferred embodiment of a height-adjustable armrest unit for a chair 2 according to this invention includes a support 3 mounted on one side of a seat 21 of the chair 2, a generally upright sleeve 4, a leverage body 5, and a biasing member in the form of a leaf spring 517.

As illustrated, the support 3 includes a horizontal plate portion 31 fixed to a lower surface of the seat 21, and an upright plate portion 32 which has an upright guiding slot 321 formed therethrough and a column of engaging notches 322 communicated with the slot 321.

The sleeve 4 is sleeved on the support 3 in such a manner that the upright plate portion 32 extends into the sleeve 4 via a generally rectangular opening 411 formed through the lower end portion of the sleeve 4.

The leverage body 5 includes an elongated slide member 51, an elongated guiding member 52 and a push rod 53. The slide member 51 and the guiding member 52 are disposed on two sides of the plate portion 32 in such a manner that the slot 321 is sandwiched between the lower end portion 513 of the slide member 51 and the guiding member 52. Thus, an actuated end upper portion 515 and an intermediate portion 511 of the slide member 51 are located above the top end portion of the plate portion 32. The lower end portion 513 of the slide member 51 has an axial lock pin 514 extending slidably through the guiding slot 321 in the plate portion 32 and fixed in a lower hollow end 522 of the guiding member 52. A horizontal pivot 48 extends through an upper hollow end 521 of the guiding member 52, and through a tubular hollow member 512 in the intermediate portion 511 of the slide member 51 and is fixed on a first inner wall 41 of the upright sleeve 4, thereby mounting pivotally the slide member 51 and the guiding member 52 on the sleeve 4. The push rod 53 has a coupling inner end 532 which is formed with an engaging notch 533 and which is connected to the axial extending driven pin 516 in the upper end portion 515 of the slide member 51, and an enlarged outer end 531 which protrudes outwardly of an opening 46 formed through the upright sleeve 4.

The leaf spring 517 has a fixed end connected integrally to the intermediate portion 511 of the slide member 51, and a free end **517*a* which abuts against a second inner wall 45 of the upright sleeve 4 in a radial direction such that the lock pin 514 engages the lowermost notch 322 at a normal position. The first and second inner walls 41, 45 of the sleeve 4 are generally transverse to each other. The sleeve 4 further has two spaced upright stop plates 44 which abut against two sides of the plate portion 32 of the support 3 so as to prevent rotation of the sleeve 4 on the support 3**.

A pair of locking bolts 43 extend through two holes 421 in the upper portion 42 of the sleeve 4 so as to be threaded in the lower surface of a horizontal armrest plate 6, thereby fixing the latter on the sleeve 4 to permit resting of a user's arm thereon.

Figure 4:
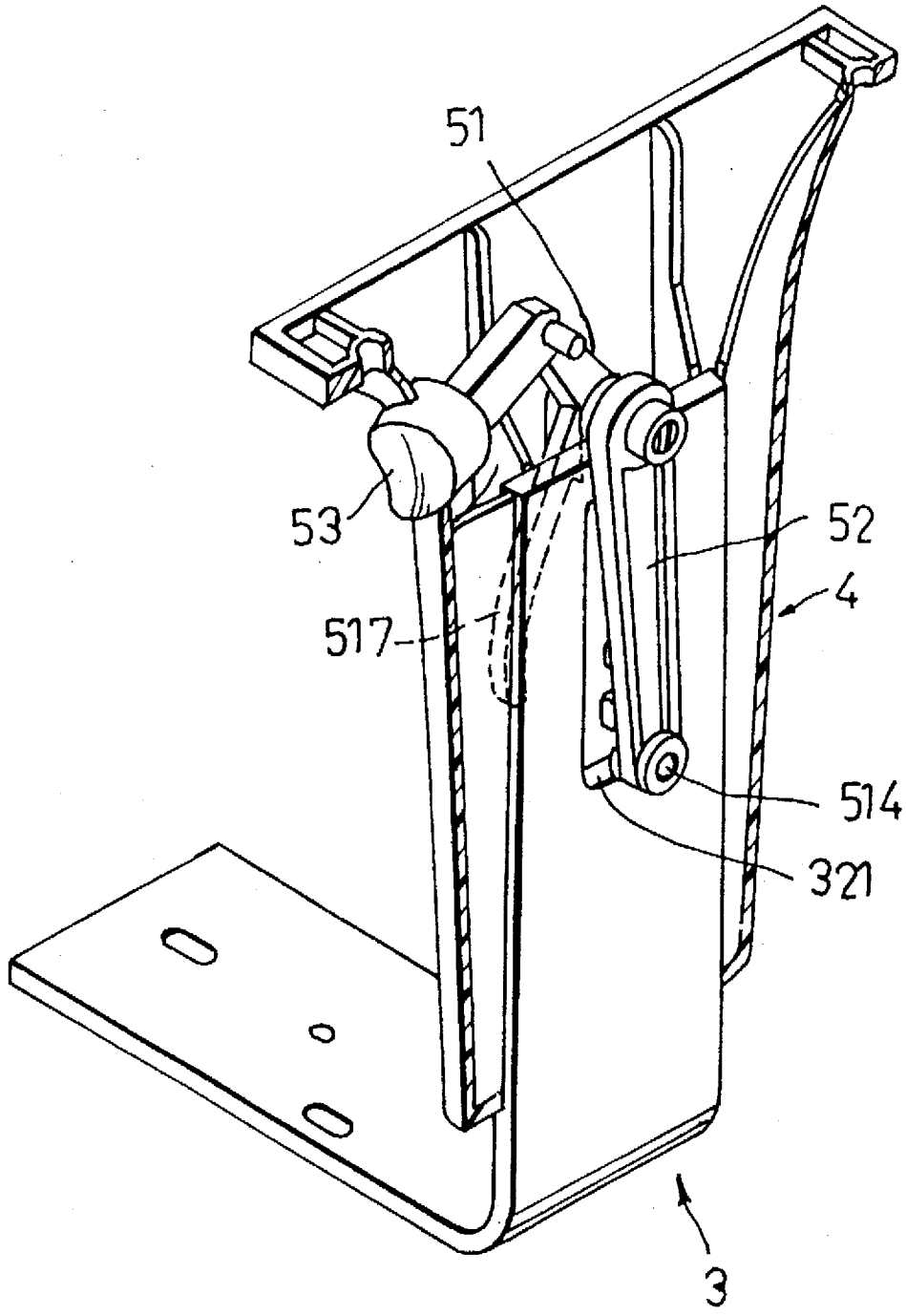
FIG. 4 is a partly sectional perspective view illustrating the interior of the armrest unit of this invention before a height adjustment operation.
Figure 5:
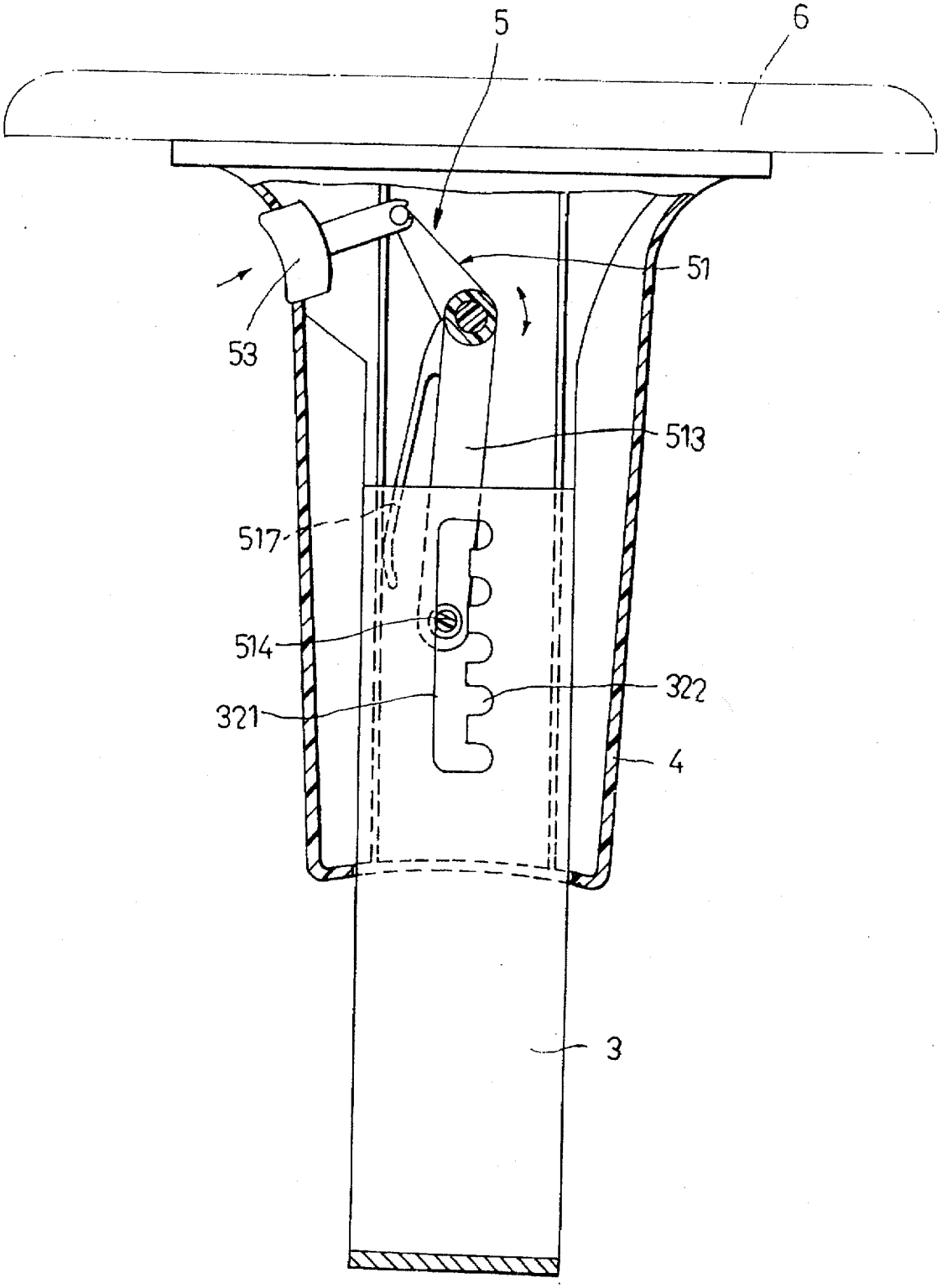
FIG. 5 is a partly sectional schematic view illustrating the interior of the armrest unit of this invention after the height adjustment operation.

Referring to FIGS. 4 and 5, when it is desired to adjust the height of the armrest plate 6 relative to the seat of the chair (not shown), the push rod 53 is externally compressed against the biasing action of the leaf spring 517, wherein the lower end portion 513 of the slide member 51 and the guiding member 52 rotate in a clockwise direction so that the lock pin 514 disengages from the lowermost notch 322 and retracts into the slot 321. Then, the leverage body 5 and the upright sleeve 4 are moved upward relative to the support 3 by shifting the lock pin 514 along the guiding slot 321. Removal of the applied force from the push rod 53 enables engagement of the lock pin 514 with another one of the notches 322. Since the lock pin 514 is confined movably along the slot 321 of the support 3, disengagement of the leverage body 5 and the sleeve 4 from the support 3 is consequently prevented.

With this invention thus explained, it is obvious to those skilled in the art that various modifications and variations can be made without departing from the scope and spirit thereof. It is therefore intended that the invention be limited only as in the appended claims.

I claim:

1. A height-adjustable armrest unit for a chair, comprising:

a support adapted to be mounted on a seat of the chair and including an upright plate portion with an upright guiding slot formed therethrough and a column of engaging notches communicated with said slot;

a generally upright sleeve mounted on said upright plate portion of said support;

a leverage body including an intermediate portion mounted pivotally on a first inner wall of said generally upright sleeve, an actuated upper end portion, and a lower end portion with a lock pin axially projecting therefrom to be slidably inserted into said guiding slot, said intermediate portion including a tubular hollow member axially extending therefrom for pivotally mounting on said first inner wall of said upright sleeve;

means for biasing said lock pin to engage a selected one of said notches, whereby, while said actuated upper end portion of said leverage body is being actuated against biasing action of said biasing means to disengage said lock pin from the selected one of said notches and to retract said lock pin into said guiding slot, said leverage body and said upright sleeve can be moved relative to said support by shifting said lock pin along said guiding slot to enable engagement of said lock pin with another one of said notches; and an elongated guiding member having an upper hollow end to be fitted on said tubular hollow member, and a lower hollow end to be fitted on said lock pin so as to dispose said guiding member on an opposite side of said upright plate portion relative to said lower end portion of said leverage body, thereby assisting guided movement of said lock pin along said guiding slot.

2. A height-adjustable armrest unit according to claim 1, wherein said biasing means is a leaf spring having a fixed end connected to said intermediate portion and a free end abutting in a radial direction against a second inner wall of said upright sleeve which is transverse to said first inner wall.

3. A height-adjustable armrest unit according to claim 2, wherein, upon actuation of said actuated upper end, said free end of said leaf spring is compressed against said second inner wall, thereby biasing said lock pin to engage another one of said notches.

4. A height-adjustable armrest unit according to claim 1, wherein said actuated upper end portion has a driven pin axially extending therefrom, said armrest unit further comprising a push rod movably disposed in said upright sleeve, said push rod having a coupling inner end for gripping said driven pin and an enlarged outer end extending outwardly of said upright sleeve so as to be depressed externally to turn said driven pin.

* * * * *